US010633227B2

(12) United States Patent
Brueckner

(10) Patent No.: US 10,633,227 B2
(45) Date of Patent: Apr. 28, 2020

(54) METHOD FOR RAISING STRUT, AND CRANE

(71) Applicant: KOBELCO CONSTRUCTION MACHINERY CO., LTD., Hiroshima-shi (JP)

(72) Inventor: Detlef Brueckner, Braunschweig (DE)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 54 days.

(21) Appl. No.: 15/995,362

(22) Filed: Jun. 1, 2018

(65) Prior Publication Data

US 2018/0346290 A1 Dec. 6, 2018

(30) Foreign Application Priority Data

Jun. 5, 2017 (JP) ..... 2017-110704

(51) Int. Cl.

*B66C 23/34* (2006.01)
*B66C 23/68* (2006.01)
*B66C 23/42* (2006.01)
*B66C 23/82* (2006.01)

(52) U.S. Cl.

CPC ..... *B66C 23/346* (2013.01); *B66C 23/42* (2013.01); *B66C 23/68* (2013.01); *B66C 23/82* (2013.01)

(58) Field of Classification Search

CPC ..... B66C 23/00; B66C 23/06; B66C 23/34; B66C 23/346; B66C 23/42; B66C 23/62; B66C 23/68; B66C 23/70; B66C 23/702; B66C 23/82

See application file for complete search history.

(56) References Cited

U.S. PATENT DOCUMENTS 3,085,695 A * 4/1963 Miller ..... E02F 9/14 212/300
4,024,957 A * 5/1977 Schleis ..... B66C 23/68 212/300
4,653,655 A * 3/1987 Rathi ..... B66C 23/702 212/300

(Continued)

FOREIGN PATENT DOCUMENTS

JP 2010-241604 10/2010
JP 2014043318 A * 3/2014 ..... B66C 23/70

(Continued)

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

Disclosed is a technique of executing: a fixing step of coupling a pulling-raising rope 171 to a vicinity of a distal end 73 of a strut 70; a first raising step of pulling the pulling-raising rope 171 rearwardly to cause a swingable portion 78 of the strut 70 to swing upwardly and rearwardly; a second raising step of pulling the pulling-raising rope 171 rearwardly until a strut body portion 76 has a rearwardly inclined posture with respect to a vertical direction; a strut returning step of pulling a pulling-returning rope 23*a* forwardly to a position where a forward swinging movement of the swingable portion 78 with respect to the strut body portion 76 is restricted; and a coupling step of coupling the swingable portion 78 and the strut body portion 76 to each other in a non-swingable manner.

2 Claims, 11 Drawing Sheets

(56) References Cited

U.S. PATENT DOCUMENTS

| | | | | | |
|---|---|---|---|---|---|
| 5,842,587 | A * | 12/1998 | Wanek | B66C 23/82 212/177 |
| 2010/0243595 | A1 | 9/2010 | Walker et al. | |
| 2010/0294738 | A1 * | 11/2010 | Martin | B66C 23/344 212/347 |
| 2014/0231374 | A1 * | 8/2014 | Foust | B66C 23/70 212/347 |

FOREIGN PATENT DOCUMENTS

| | | | | |
|---|---|---|---|---|
| JP | 2016222359 | A * | 12/2016 | B66C 23/348 |
| WO | WO-2017090688 | A1 * | 6/2017 | B66C 23/70 |

* cited by examiner

METHOD FOR RAISING STRUT, AND CRANE

TECHNICAL FIELD

The present invention relates to a method for raising a strut comprised in a crane, and a crane.

BACKGROUND ART

Heretofore, there has been known a crane comprising a crane base, a boom attached to the crane base in a raisable and lowerable manner, a jib attached to a distal end of the boom in a raisable and lowerable manner; a hook suspended from a distal end of the jib, and a strut attached to the boom a raisable and lowerable manner to support the jib.

This type of crane is assembled into a workable state in a work area or the like. For example, the strut and the boom are laid down, and in this state, the strut is pulled and raised upwardly with respect to the boom.

As a specific way to pull and raise this strut, it is conceivable to fix a rope to a distal end of the strut, and pull this rope to cause the strut to swing upwardly with respect to the boom. However, a crane equipped with a strut is generally a large-size crane, so that the strut has relatively large overall length and heavy weight. Moreover, in a situation where the strut is laid down, a force can be applied from a height position adjacent to an installation surface of the crane to the strut, only in a direction close to a horizontal direction. Therefore, an extremely large force is required to pull and raise the entire strut simply by pulling the rope at the height position adjacent to the installation surface.

As a measure against this problem, there has been known a technique of raising the strut using an auxiliary crane. For example, JP 2010-241604A (Patent Literature 1) discloses a method of raising a strut of a crane, wherein the strut comprises a base end-side portion located on the side of a base end thereof, and a distal end-side portion located on the side of a distal end thereof and swingably coupled to the base end-side portion. The method comprises: laying down the strut on an installation surface while folding the strut such that a distal end of the distal end-side portion of the strut is oriented toward the base end of the strut; in this state, attaching a rope to the distal end of the strut; and using an auxiliary crane to lifting the rope until the strut is set in a posture where it extends linearly upwardly from the base end thereof.

The strut raising method disclosed in the Patent Literature 1 requires lifting the entire strut by a distance corresponding to a length from the base end to the distal end of the strut, using the auxiliary crane. Thus, it is necessary to prepare a high-performance auxiliary crane having a high withstand load and a long lifting height.

SUMMARY OF INVENTION

The present invention has been made in view of the above circumstances, and an object thereof is to provide a strut raising method and a crane each capable of efficiently raising a strut, without using any auxiliary crane or while keeping down performance required for an auxiliary crane.

In order to achieve to above object, the present invention provides a strut raising method used for a crane comprising: a crane base; a boom attached to the crane base in a raisable and lowerable manner; a jib attached to the boom in a raisable and lowerable manner; and a strut for supporting the jib, wherein the strut has a base end attached to the boom in a raisable and lowerable manner and a distal end located on a side opposite to the base end. The strut raising method comprises: configuring the strut such that it comprises: a strut body portion including the base end; a swingable portion including the distal end, wherein the swingable portion is located closer to a distal edge of the strut than the strut body portion and swingably coupled to the strut body portion; and a restriction portion for restricting a swinging movement of the swingable portion with respect to the strut body portion; fixing a pulling-raising rope to a vicinity of the distal end of the strut, in a state in which the strut is located forward of the boom in terms of a forward-rearward direction of the boom, wherein the boom and the strut are laid down along an installation surface of the crane, and wherein the strut body portion is disposed to extend forwardly from the boom, and the swingable portion is disposed to extend forwardly from the strut body portion; performing a first raising operation of pulling the pulling-raising rope rearwardly to cause the swingable portion to swing upwardly and rearwardly with respect to the strut body portion after the fixing of the pulling-raising rope, up to a position where a rearward swinging movement of the swingable portion with respect to the strut body portion is restricted by the restriction portion; performing a second raising operation of pulling the pulling-raising rope rearwardly until the strut body portion has a rearwardly inclined posture with respect to a vertical direction after the first raising operation, to cause the strut body portion to swing upwardly and rearwardly with respect to the boom; pulling a pulling-returning rope coupled to the distal end of the strut forwardly to cause the swingable portion to swing forwardly with respect to the strut body portion after the second raising operation to thereby return the strut to a position where the strut body portion comes into contact with the swingable portion to thereby restrict the swingable portion from a relative forward swinging movement to the strut body portion; and coupling the swingable portion and the strut body portion to each other so as to prevent the swingable portion and the strut body portion from relative swinging movement to each other after returning the strut to the position where the strut body portion comes into contact with the swingable portion.

The present invention also provides a crane comprising: a crane base; a boom attached to the crane base in a raisable and lowerable manner; a jib attached to the boom in a raisable and lowerable manner; and a strut for supporting the jib, wherein the strut has a base end attached to the boom in a raisable and lowerable manner and a distal end located on a side opposite to the base end. In the crane, the strut comprises: a strut body portion located on the side of the base end; a swingable portion located on the side of the distal end and swingably coupled to the strut body portion; a restriction portion for restricting the swingable portion from a relative swinging movement to the strut body portion in a direction causing the angle to be increased beyond the given value, when an angle between the strut body portion and the swingable portion becomes a given value; and a swinging movement-restricting coupling portion capable of coupling the strut body portion and the swingable portion to each other so as to prevent the strut body portion and the swingable portion from a relative swinging movement to each other, and wherein the strut has, in a vicinity of the distal end thereof, a first holding portion for allowing a pulling-raising rope for pulling the swingable portion toward the boom to be fixed thereto, and a second holding portion for allowing a pulling-returning rope for pulling the swingable portion in a direction away from the boom to be coupled thereto.

This method and this crane makes it possible to efficiently pull and raise the strut, while eliminating the use of an auxiliary crane for lifting the strut or while keep down performance (maximum lifting height and withstand load) required for the auxiliary crane.

As above, the present invention provides the strut raising method and the crane each capable of efficiently raising the strut, without using any auxiliary crane or while keeping down performance required for an auxiliary crane.

DESCRIPTION OF EMBODIMENTS

With reference to the drawings, the present invention will now be described based on one embodiment thereof. It should be understood that the following embodiment is a specific example of the present invention, and is not intended to restrict a technical scope of the present invention.

In this regard, respective figures referred to below have been prepared to depict, for convenience of explanation, only key members among complete members of a crane X1 according to this embodiment, in a simplified manner. Therefore, the crane X1 according to this embodiment can comprise any other members or any other steps which are not depicted in the figures referred to in this specification.

(1) Overall Configuration of Crane

Figure 1:
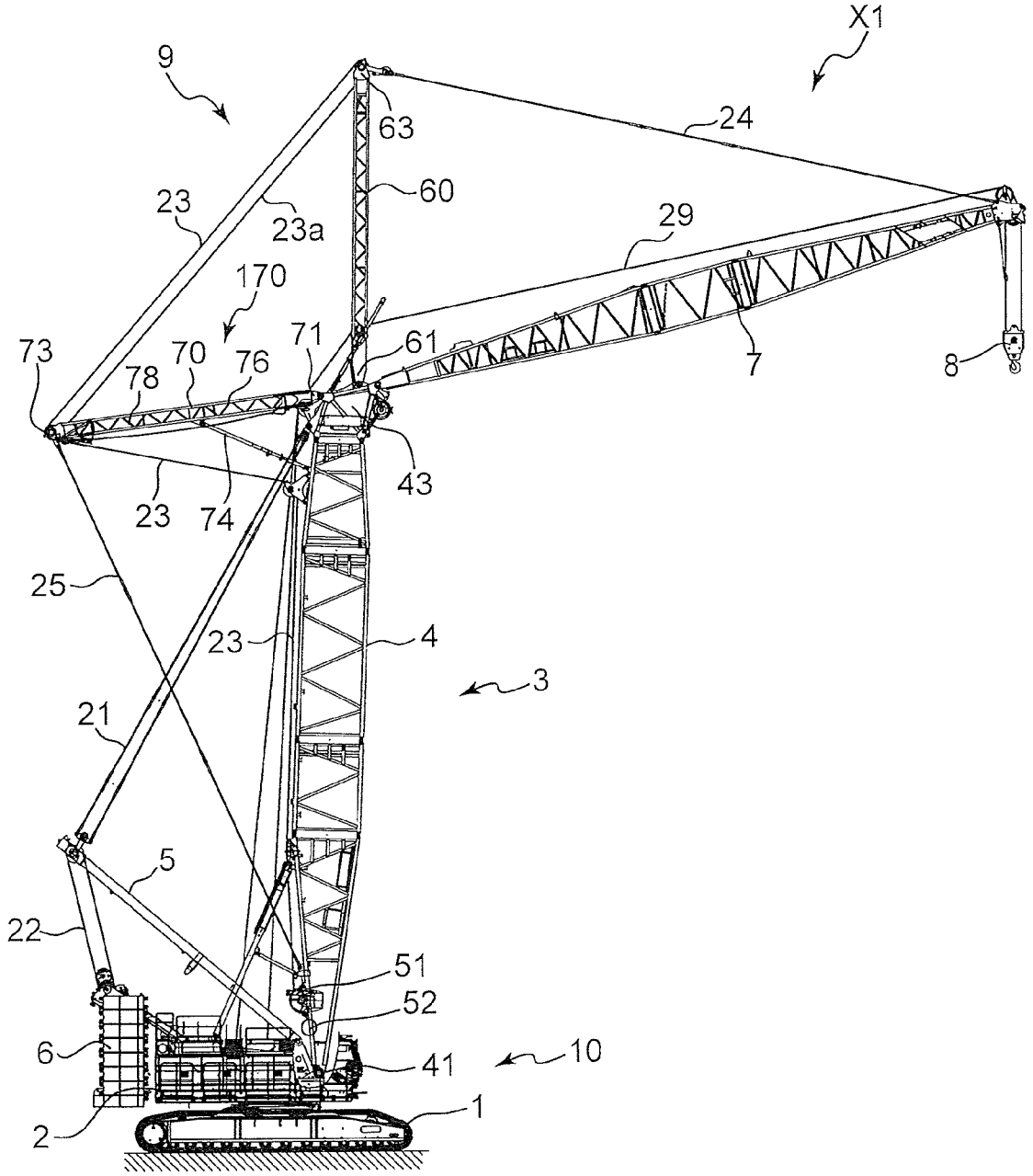
FIG. 1 is a side view depicting a configuration of a crane according to one embodiment of the present invention.

FIG. 1 depicts the crane X1 according to this embodiment. FIG. 1 depicts the crane X1 in an assembled state, i.e., in a state in which it is usable for load-carrying work.

The crane X1 depicted in FIG. 1 comprises: a crane base 10 comprising a lower traveling body 1 and an upper slewing body 2 disposed on the lower traveling body 1; and an attachment 3 attached to the upper slewing body 2. The following description will be made on an assumption that a rightward direction and a leftward direction in FIG. 1 are a forward direction and a rearward direction, respectively, as needed basis.

The lower traveling body 1 of the crane base 10 is constructed to be capable of traveling along the ground, e.g., comprises a pair of crawlers. The upper slewing body 2 of the crane base 10 is constructed to be capable of slewing about an axis extending in a direction perpendicular to a traveling surface along which the lower traveling body 1 travels, i.e., an installation surface of the crane X1.

The attachment 3 is used to perform load-lifting and load-lowering works.

The attachment 3 comprises: a boom 4 which is raisable and lowerable with respect to the upper slewing body 2; a mast 5 connected to the boom 4; a balance weight 6 provided on the upper slewing body 2; a jib 7 which is raisable and lowerable with respect the boom 4; a hook 8 for holding a load; and a strut unit 9.

The boom 4 has a base end 41 swingably attached to the upper slewing body 2, and a distal end 43 located on an opposite side of the base end 41. The distal end 43 of the boom 4 is connected, through a guying line 21, to a distal end of the mast 5 attached to the upper slewing body 2. The distal end of the mast 5 is connected to the balance weight 6 through a wire rope 22. When the wire rope 22 connecting the mast 5 and the balance weight 6 together is wound or unwound on/from a mast winch, an inclination angle of the mast 5 with respect to the ground is changed, and thereby the boom 4 connected to the mast 5 is raised or lowered.

The boom 4 is fixedly provided with a jib raising-lowering winch 51 for performing winding and unwinding of an aftermentioned jib raising-lowering wire rope 23, and an auxiliary winch 52 for perfoiining winding and unwinding of an aftermentioned pulling-raising wire rope (pulling-raising rope) 171. These winches 51, 52 are attached to a rear surface of a base-end portion of the boom 4 on the side of the base end 41 thereof.

Alternatively, these winches 51, 52 may be provided on the upper slewing body 2. Further, although the auxiliary winch 52 may be provided only for the purpose of winding and unwinding of the aftermentioned pulling-raising wire rope (pulling-raising rope) 171, any suitable winch used for other purpose may be utilized as the auxiliary winch 52. For example, a winch for performing winding and unwinding, e.g., of an aftermentioned wire rope 29 for lifting and lowering the hook 8 may be utilized as the auxiliary winch 52.

The jib 7 is attached to the distal end 43 of the boom 4. A base end of the jib 7 is swingably attached to the distal end 43 of the boom 4, and, based on this structure, the jib 7 is constructed to be raisable and lowerable with respect to the boom 4.

The hook 8 is suspended from the distal end of the jib 7. Specifically, the hook 8 is attached to a wire rope 29 connected to a hook winch provided on the upper slewing body 2, and suspended from the distal end of the jib 7 in such a manner that it is vertically moved when the wire rope 29 is wound or unwound on/from the hook winch.

The strut unit 9 is attached to the distal end 43 of the boom 4. The strut unit 9 supports the jib 7 at a position rearward of the jib 7 so as to prevent the jib 7 from falling down forwardly.

The strut unit 9 comprises: a front strut 60; a rear strut unit 170 disposed rearward of the front strut 60; a jib guying line 24; the jib raising-lowering wire rope 23; a supporting wire rope 25.

The front strut 60 is attached to the boom 4 in a raisable and lowerable manner. Specifically, the front strut 60 has: a base end 61 attached to the distal end 43 of the boom 4 in a raisable and lowerable manner, i.e., swingably; and a distal end 63 located on a side opposite to the base end 61.

The jib guying line 24 connects the front strut 60 and the jib 7 together, so that the jib 7 is supported by the front strut 60 through the jib guying line 24. The jib guying line 24 connects the distal end 63 of the front strut 60 and the distal end of the jib 7 together.

The rear strut unit 170 comprises a rear strut 70 supporting the front strut 60, and a back stop 74 supporting the rear strut 74 so as to prevent the rear strut 70 from falling down rearwardly.

The back stop 74 is a member coupling the rear strut 70 and the boom 4 together, and is capable of restricting fall-down of the rear strut 70 toward the boom 4.

The rear strut 70 is equivalent to "strut" set forth in the appended claims. In this embodiment, the jib 7 is supported by the two struts: the front strut 60 and the rear strut 70, as mentioned above. However, the support structure is not limited thereto, but the jib may be supported by only one strut.

The rear strut 70 is located rearward of the front strut 60. The rear strut 70 is attached to the distal end 43 of the boom 4 in a raisable and lowerable manner. Specifically, the rear strut 70 has a base end 71 attached to the distal end 43 of the boom 4, and a distal end 73 located on a side opposite to the base end 71.

The supporting wire rope 25 connects the distal end 73 of the rear strut 70 and the base-end portion of the boom 4 together. The jib raising-lowering wire rope 23 connects the front strut 60 and the rear strut 70 together. Thus, the jib 7 is supported by the jib guying line 24 and the two wire ropes 25, 23 through the rear strut 60 and the rear strut 70.

The jib raising-lowering wire rope 23 has one end fixed to the distal end 73 of the rear strut 70, and the other end wound on the jib raising-lowering winch 51.

More specifically, the jib raising-lowering wire rope 23 is disposed to extend from the distal end 73 of the rear strut 70 toward the distal end 63 of the front strut 60, and, after being wound around a sheave 65 (see FIG. 5), returned to the distal end 73 of the rear strut 70 again. Then, the jib raising-lowering wire rope 23 is disposed to extend from the distal end 73 of the rear strut 70 toward the distal end 43 of the boom 4 and further extend toward the jib raising-lowering winch 51 along a rear surface of the boom 4.

The jib raising-lowering winch 51 is a winch for performing winding and unwinding of the jib raising-lowering wire rope 23, and, based on the winding and unwinding, an angle between the front strut 60 and the rear strut 70 is changed. As a result, the jib 7 is raised or lowered with respect to the boom 4.

Specifically, when the jib raising-lowering winch 51 winds the jib raising-lowering wire rope 23, a pulling force directed toward the front strut 60 is generated in a portion 23*a* of the jib raising-lowering wire rope 23 extending from the one end thereof fixed to the distal end 73 of the rear strut 70 toward the distal end 63 of the front strut 60, and the portion 23*a* pulls the distal end 73 of the rear strut 70 toward the front strut 60, i.e., in a direction away from the boom 4. As a result, the angle between the struts 60, 70 is reduced.

On the other hand, when the jib raising-lowering winch 51 unwinds the jib raising-lowering wire rope 23, the portion 23*a* of the jib raising-lowering wire rope 23 extending from the one end thereof fixed to the distal end 73 of the rear strut 70 toward the front strut 60 gradually becomes longer, and thus the one end of the jib raising-lowering wire rope 23 fixed to the distal end 73 of the rear strut 70 is gradually moved away from the front strut 60, so that the angle between the struts 60, 70 is increased.

The back stop 74 is located rearward of the rear strut 70. The back stop 74 is fixed to the rear strut 70. The back stop 74 is brought into contact with the boom 4 to thereby stop a rearward swinging movement of the rear strut 70.

(2) Detailed Structure of Rear Strut

Figure 2:
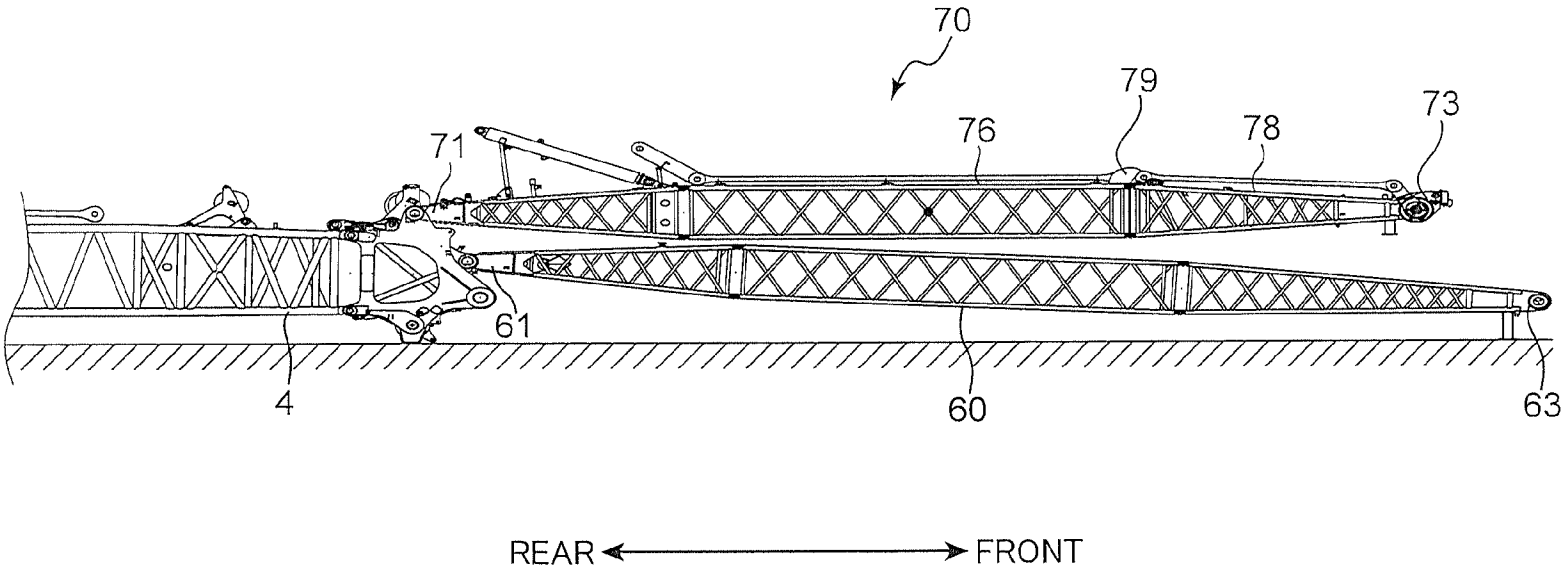
FIG. 2 is a side view depicting a part of the crane in a state before start of a fixing step.

With reference to FIG. 2 and others, a detailed structure of the rear strut 70 will be described. In a location where the crane X1 according to this embodiment is used to carry a load, or a vicinity thereof, the crane X1 is assembled into a state capable of carrying a load, as depicted in FIG. 1, by raising the boon 4, the jib 7 and the strut unit 9 which are laid down on an installation surface of the crane X1. FIG. 2 depicts a state before raising the boom 4 and the strut unit 9, wherein the boom 4 and the strut unit 9 are laid down on an installation surface such as a ground surface on which the crane X1 is installed, and set in a posture where they extends along the installation surface. It should be noted that depicting of the jib 7 is omitted in FIG. 2.

The following description will be made on an assumption that a rightward direction and a leftward direction in FIG. 2 are a forward direction and a rearward direction, respectively, as needed basis.

At an intermediate position, the rear strut 70 is divided into two parts consisting of a swingable portion 78 located on the side of the distal end 73 and a strut body portion 76 located on the side of the base end 71. The strut body portion 76 of the rear strut 70 may be further divided into two parts, and the two parts may be coupled together such that they can be integrally swung. Specifically, the rear strut 70 is divided at a position offset toward the distal end with respect to a central position thereof in the forward-rearward direction, so that an length of the swingable portion 78 in the forward-rearward direction is less than that of the strut body portion 76. Accordingly, a weight of the swingable portion 78 is less than a weight of the strut body portion 76.

The swingable portion 78 is swingably coupled to the strut body portion 76. Specifically, as indicated by a solid line and a broken line in FIG. 3, the swingable portion 78 is coupled to the strut body portion 76 swingably rearwardly (in a state depicted in FIG. 2) about a pivot point defined by a joint between the swingable portion 78 and the strut body portion 76.

Figure 3:
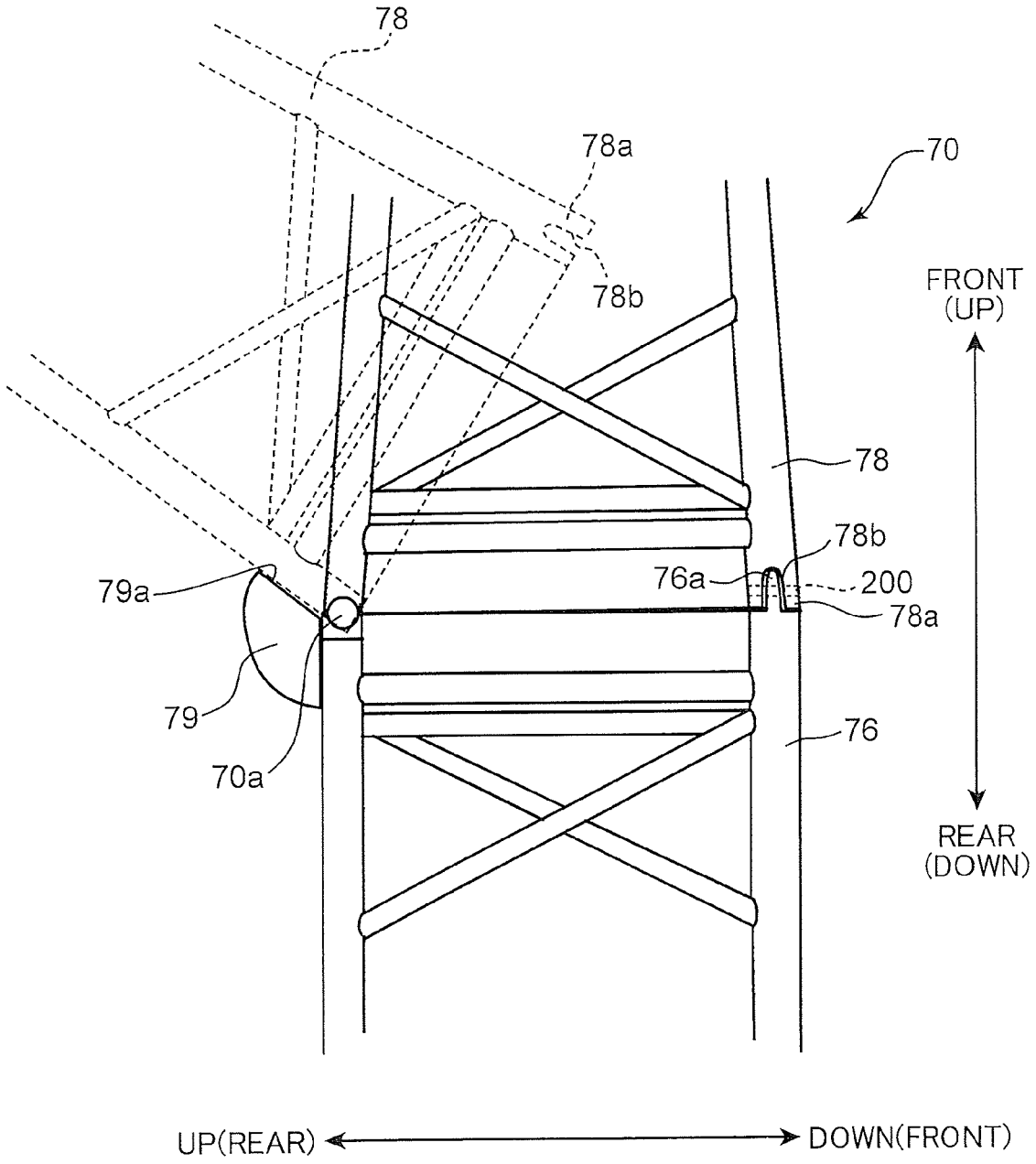
FIG. 3 is a schematic diagram enlargedly depicting a coupling section between a swingable portion and a strut body portion.

FIG. 3 is a schematic diagram enlargedly depicting a coupling section between the swingable portion 78 and the strut body portion 76. As depicted in FIG. 3, in this embodiment, an upper region of a front edge portion of the strut body portion 76 and an upper region of a rear edge portion of the swingable portion 78 are provided with a common shaft 70*a* penetrating therethrough to extend in a width direction of the rear strut 70 (a direction perpendicular to the drawing sheet of FIG. 3), so that the swingable portion 78 can be swung upwardly and rearwardly with respect to the strut body portion 76 about the shaft 70*a* (joint). This swing shaft may be provided to penetrate through the overall length of the strut body portion 76 and the swingable portion 78 in the direction perpendicular to the drawing sheet of FIG. 3, or may be provided only at respective end portions of the strut body portion 76 and the swingable portion 78 in the direction perpendicular to the drawing sheet of FIG. 3.

The rear strut 70 comprises a restriction portion 79 for restricting a swinging movement of the swingable portion 78 with respect to the strut body portion 76. More specifically, the restriction portion 79 is configured to prevent a swing angle of the the swingable portion 78 with respect to the strut body portion 76 from exceeding a given value, i.e., to prevent an angle between the swingable portion 78 and the strut body portion 76 from becoming less than a given value. The latter given value may be set to an angle of 90 degrees or more, e.g., about 120 degrees, and an upper limit of the swing angle of the swingable portion 78 with respect to the strut body portion 76 may be set to an angle of 90 degrees or less, e.g., about 60 degrees.

In an example depicted in FIG. 3, the restriction portion 79 is provided on an upper surface of the front edge portion of the strut body portion 76, and formed in a block shape protruding upwardly from the upper surface. The restriction portion 79 is provided on the upper surface of the front edge portion of the strut body portion 76 at each of opposite ends thereof in a lateral (width) direction of the strut body portion 76 (a horizontal direction orthogonal to in the forward-rearward direction). The restriction portion 79 has an inclined surface 79*a* extending from the upper surface of the strut body portion 76 forwardly and obliquely upwardly. As indicated by the broken line in FIG. 3, the swingable portion 78 is brought into contact with the inclined surface 79*a* in the rearward direction, so that the inclined surface 79*a* restricts a rearward movement of the swingable portion 78.

Figure 4:
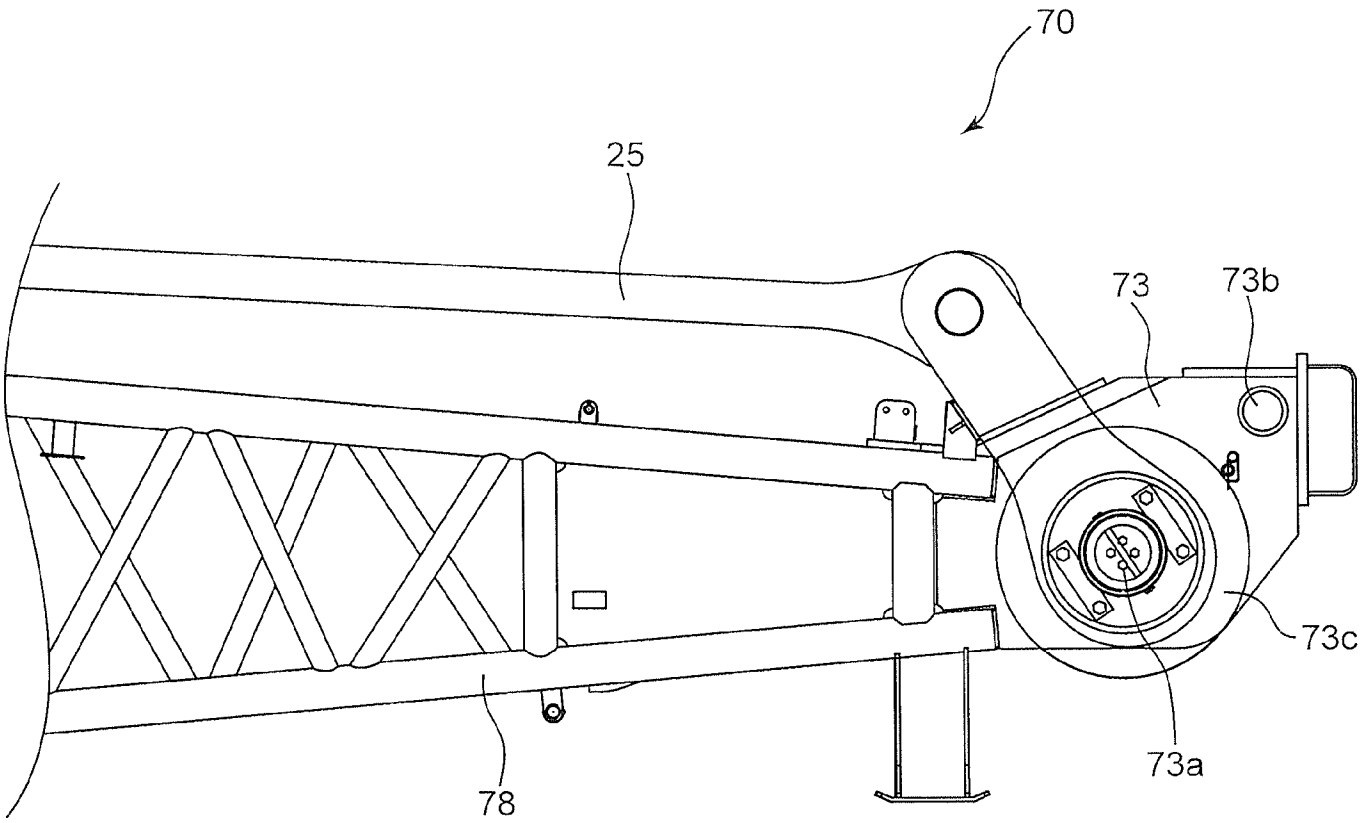
FIG. 4 is an enlarged view depicting a distal end of a rear strut and a vicinity thereof.

FIG. 4 is an enlarged view depicting the distal end 73 of the rear strut 70 and the vicinity thereof.

One end of the jib raising-lowering wire rope 23 is fixed to the distal end 73 of the rear strut 70, as mentioned above, and the rear strut 70 has a second holding portion 73*a* provided at the distal end 73 thereof to allow one end of the jib raising-lowering wire rope 23 (aftermentioned pulling-returning rope 23*a*) to be fixed thereto. The distal end 73 of the rear strut 70 is also provided with a rear sheave 73*c* around which the jib raising-lowering wire rope 23 is wound.

Further, the distal end 73 of the rear strut 70 is provided with a first holding portion 73*b* for allowing one end of the aftermentioned pulling-raising wire rope 171 to be fixed thereto.

(3) Strut Raining Process

A process of an operation of raising the rear strut 70, in an assembling operation for the crane X1, will be described below.

(3-1) Fixing Step

Figure 5:
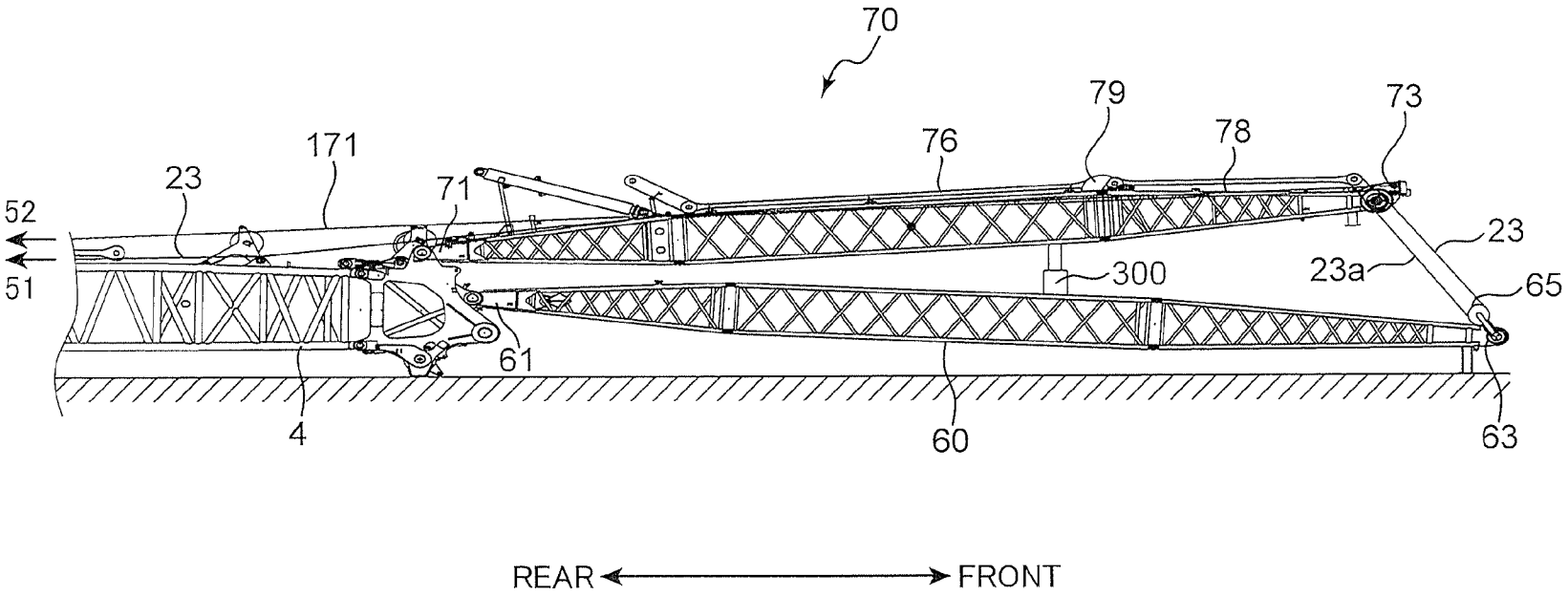
FIG. 5 is a side view for explaining the fixing step.

First of all, as depicted in FIG. 5, in the state in which each of the boom 4 and the strut unit 9 is set in a posture where it is laid down along the installation surface (e.g., in a posture where it extends approximately horizontally at a height position adjacent to a ground surface), one end of a pulling-raising wire rope 171 having the other end fixed to the auxiliary winch 52 is fixed to the first holding portion 73*b* at the distal end 73 of the rear strut 70. In this embodiment, a rope sling is attached to the first holding portion 73*b*, and the pulling-raising wire rope 171 is tied with the rope sling.

Further, one end of the jib raising-lowering wire rope 23 having the other end connected to the jib raising-lowering winch 51 is fixed to the second holding portion 73*a* at the distal end 73 of the rear strut 70. In this operation, as depicted in FIG. 5, the jib raising-lowering wire rope 23 is wound around the sheave 65, and this sheave 65 is coupled to the distal end 63 of the front strut 60 to couple the rear strut 70 and the front strut 60 together through the jib raising-lowering wire rope 23. Further, the jib raising-lowering wire rope 23 is routed such that it extends from the sheave 65 to the jib raising-lowering winch 51 via the rear sheave 73*c* provided at the distal end 73 of the rear strut 70.

Instead of the above process, the jib raising-lowering wire rope 23 is wound around the sheave 65, and in this state, this sheave 65 may be fixed to the second holding portion 73*a*. The operation of fixing the jib raising-lowering wire rope 23 to the second holding portion 73*a* at the distal end 73 of the rear strut 70 may be performed before the raising operation for the rear strut 70, or may be performed before the assembling operation for the crane X1. For example, the rear strut 70 may be carried in a location for the assembling operation, in a state in which the jib raising-lowering wire rope 23 is already attached to the second holding portion 73*a*.

In this embodiment, before the operation of fixing the ropes 23, 171, the rear strut 70 is disposed above the front strut 60, as depicted in FIG. 5. Further, before fixing the pulling-raising wire rope 171 to the first holding portion 73*b*, the distal end of the rear strut 70 is held at a position spaced upwardly from the front strut 60, as depicted in FIG. 5. For example, the rear strut 70 is pushed upwardly by a hydraulic jack 300. The hydraulic jack 300 may disposed at a position of the swingable portion 78, or may be disposed at a position of the strut body portion 76.

(3-2) First Pulling and Raising Step

Subsequently, the pulling-raising wire rope 171 is wound by the auxiliary winch 52, so that the pulling-raising wire rope 171 is pulled rearwardly, i.e., toward the boom 4.

When the pulling-raising wire rope 171 is pulled rearwardly, a rearward force is applied to the distal end 73 of the rear strut 70, i.e., the distal end 73 of the swingable portion 78. As a result, as depicted in FIG. 6, the swingable portion 78 of the rear strut 70 is swung rearwardly and upwardly about a pivot point defined by the joint between the swingable portion 78 and the strut body portion 76.

However, the rear strut 70 is provided with the restriction portion 79, as mentioned above. Thus, as depicted in FIG. 7, a rearward swinging movement of the swingable portion 78 with respect to the strut body portion 76 is stopped at a time when the swing angle becomes a given value (in this embodiment, at a time when an angle between the swingable portion 78 and the strut body portion 76 becomes about 120 degrees, as mentioned above, i.e., the swingable portion 78 is swung by about 60 degrees).

In other words, in the first raising step, until the rearward swinging movement of the swingable portion 78 with respect to the strut body portion 76 is restricted by the restriction portion 79, the pulling-raising wire rope 171 is wound by the auxiliary winch 52 to cause the swingable portion 78 to swing rearwardly.

Figure 6:
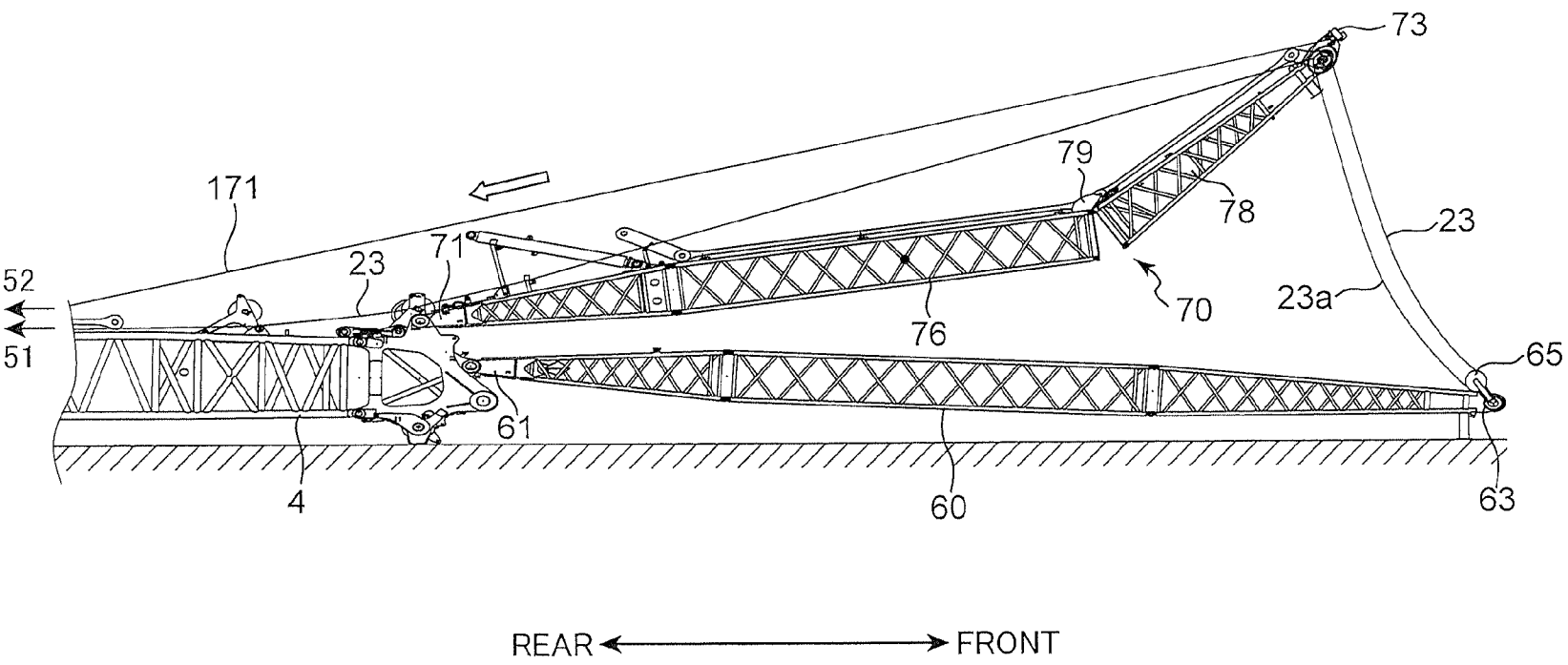
FIG. 6 is a side view depicting a part of the crane in a state during a first raising step.
Figure 7:
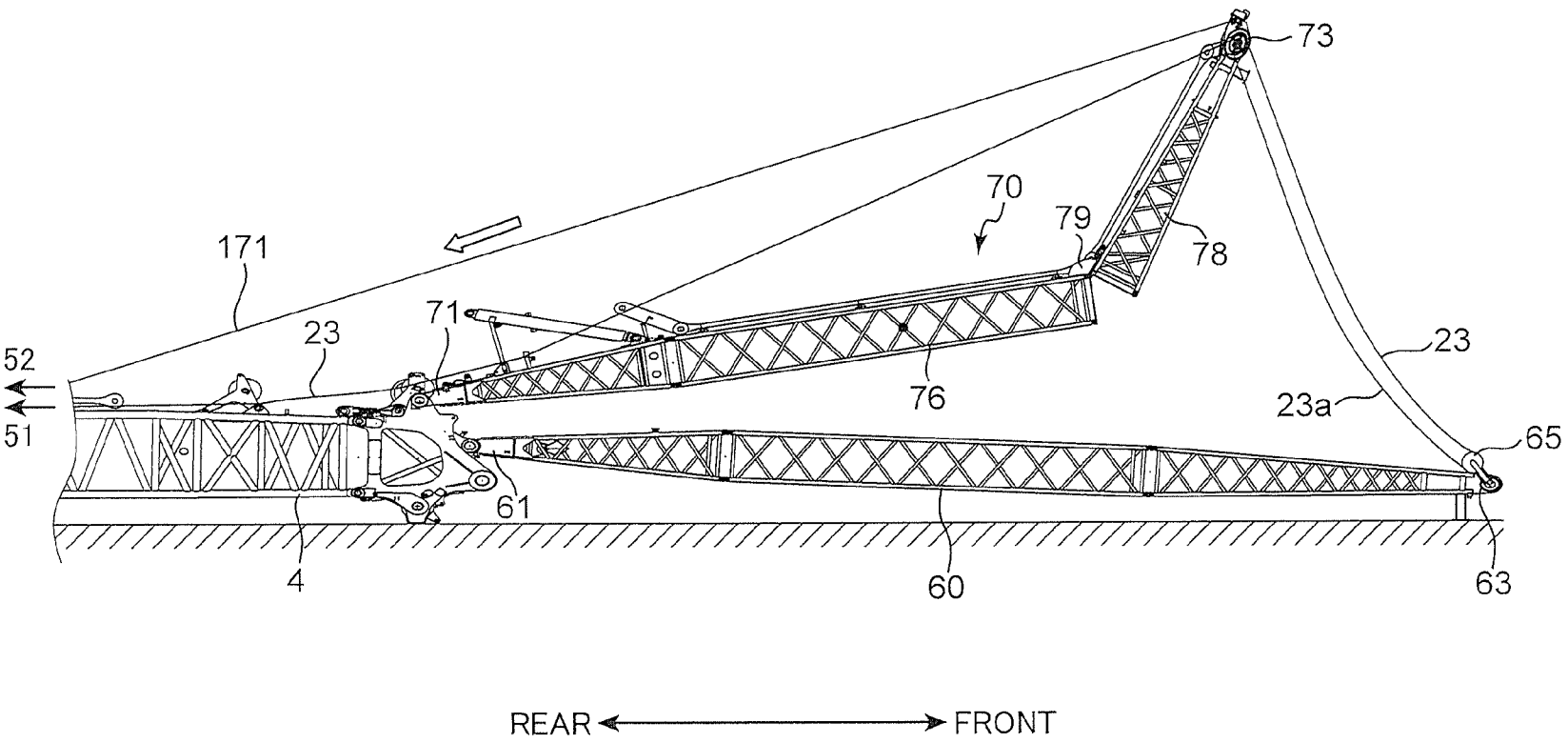
FIG. 7 is a side view depicting a part of the crane in a state just before start of a second raising step.

In the example depicted in FIGS. 6 and 7, during this operation, the rearward force is also applied to the strut body portion 76 via the swingable portion 78, so that the strut body portion 76 is also slightly swung rearwardly and upwardly about a pivot point defined by a joint between the strut body portion 76 and the boom 4.

In this embodiment, although the distal end of the rear strut 70 is pushed upwardly before start of the first raising step, as mentioned above, the pulling-raising wire rope 171 and the rear strut 70 are disposed to extend along the installation surface and approximately parallel to each other, before start of the first raising step. Thus, an upward component of a force caused by pulling the pulling-raising wire rope 171 rearwardly and applied to the rear strut 70 is kept down. However, in this first raising step, only the low-weight swingable portion 78 in the rear strut 70 is swung upwardly and rearwardly, so that it is only necessary to apply a relatively small force to the pulling-raising rope so as to realize the swinging movement. Therefore, in this first raising step, it becomes possible to pull and raise the swingable portion 78 while keeping down a force to be applied to the pulling-raising rope.

(3-3) Second Puling and Raising Step

Subsequently, in the state in which the rearward swinging movement of the swingable portion 78 with respect to the strut body portion 76 is restricted, the pulling-raising wire rope 171 is further wound by the auxiliary winch 52. Thus, the distal end 73 of the swingable portion 78 is further pulled rearwardly by the pulling-raising wire rope 171.

Figure 8:
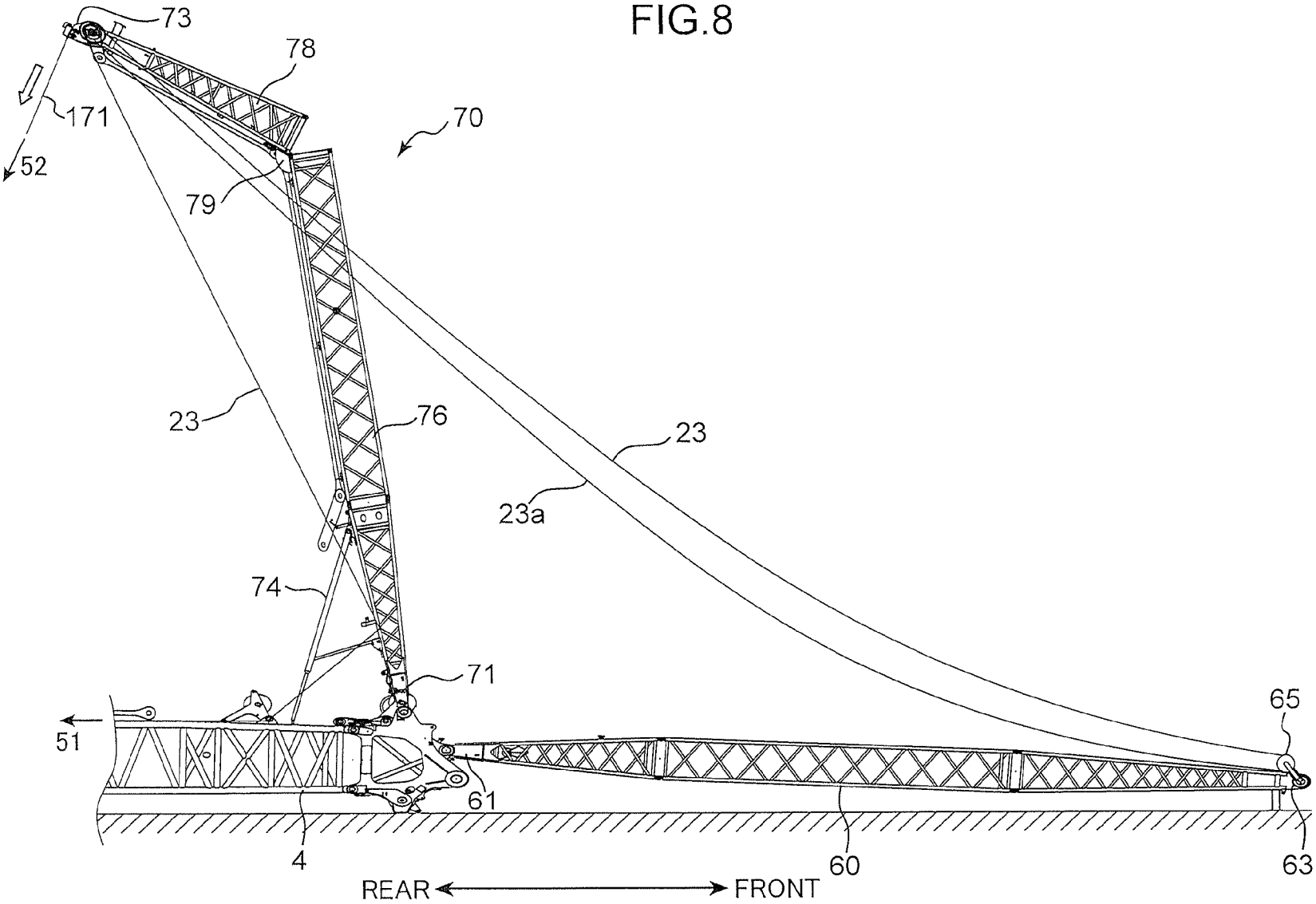
FIG. 8 is a side view depicting a part of the crane in a state just before start of a strut returning step.

When the rearward force is applied to the distal end 73 of the swingable portion 78 in the above manner, in the state in which the rearward swinging movement of the swingable portion 78 with respect to the strut body portion 76 is restricted, the strut body portion 76 is swung rearwardly and upwardly about a pivot point defined by the joint between the strut body portion 76 and the boom 4, with respect to the state depicted in FIG. 7, while the angle between the swingable portion 78 and the strut body portion 76 is maintained constant, as depicted in FIG. 8. As a result, the strut body portion 76 is pulled and raised upwardly.

The auxiliary winch 52 is operated to perform the winding operation of for the pulling-raising wire rope 171, until the strut body portion 76 is set in a posture where it is inclined rearwardly with respect to a vertical direction, as depicted in FIG. 8.

In this embodiment, when the strut body portion 76 is set in the posture where it is inclined rearwardly with respect to the vertical direction, in the above manner, the rear strut 70 (strut body portion 76) is coupled to the boom 4 through the back stop 74.

In the first raising step and the second raising step, in order to realize the swinging movement of the rear strut 70 without applying excessive tension from the jib raising-lowering wire rope 23 to the front strut 60 and the rear strut 70, a portion of the jib raising-lowering wire rope 23 extending between the front strut 60 and the rear strut 70 is slackened.

This second raising step is performed in the state in which the swingable portion 78, i.e., a distal end-side portion of the rear strut 70 to which the pulling-raising wire rope 171 is fixed, is pulled upwardly by performing the first raising step. Therefore, in this second raising step, it becomes possible to increase an upward component of a force to be applied from the pulling-raising wire rope 171 to the rear strut 70, and thus pull and raise the strut body portion 76 and the rear strut 70 while keeping down a force to be applied to the pulling-raising wire rope 171.

(3-4) Strut Returning Step

After the strut body portion 76 is set in the posture where it is inclined rearwardly with respect to the vertical direction, as mentioned above, the jib raising-lowering wire rope 23 is wound by the jib raising-lowering winch 51. By this winding, each of the distal end 73 of the swingable portion 78 and the distal end 63 of the front strut 60 to which the jib raising-lowering wire rope 23 is coupled, is applied with a force directed in a direction causing a distance therebetween to be reduced, so that the distal end 73 of the swingable portion 78 is moved toward the front strut 60, i.e., forwardly. In this operation, although the front strut 60 is also applied with a certain level of force directed in a direction causing it to be moved toward the swingable portion 78, the swingable portion 78 is moved toward the front strut 60 (forwardly), because the weight of the swingable portion 78 is less than a total weight of the front strut 60 (e.g., the total weight of the front strut 60 is set to be approximately equal to a total weight of the rear strut 70. That is, a portion 23*a* of the jib raising-lowering wire rope 23 extending from the end fixed to the distal end 73 of the swingable portion 78 to the front strut 60 will be pulled forwardly by the jib raising-lowering winch 51. Then, when the portion 23*a* is pulled forwardly, a forward force is applied to the distal end 73 of the swingable portion 78, so that the distal end 73 of the swingable portion 78 is pulled forwardly.

As above, in this embodiment, the portion 23*a* of the jib raising-lowering wire rope 23 extending from the end thereof fixed to the distal end 73 of the rear strut 70 (swingable portion 78) to the front strut 60 functions as a pulling-returning rope 23*a* for pulling the distal end 73 of the rear strut 70 forwardly. In the following description, this portion 23*a* will be occasionally referred to as "pulling-returning rope 23*a*".

The jib raising-lowering wire rope 23 may be fixed to the front strut 60 and coupled to the distal end 73 of the swingable portion 78 of the rear strut 70 via a sheave or the like. For example, the jib raising-lowering wire rope 23 may be wound around the rear sheave 73*c* provided at the distal end 73 of the swingable portion 78 of the rear strut 70 and coupled to the distal end 73 of the swingable portion 78, and further wound around the sheave 65 provided at the distal end 63 of the front strut 60 and coupled to the auxiliary winch 52. Specifically, in this case, the jib raising-lowering wire rope 23 extending from the auxiliary winch 52 is wound around a sheave at the distal end 73 of the swingable portion 78, and then wound around a sheave at the distal end 63 of the front strut 60. Then, the jib raising-lowering wire rope 23 is further wound around a sheave at the distal end 73 of the swingable portion 78, and, after extending toward the front strut 60, fixed to a vicinity of the distal end 63 of the front strut 60.

In this case, when the jib raising-lowering wire rope 23 is wound by the auxiliary winch 52, each of the swingable portion 78 of the rear strut 70 and the front strut 60 to which the jib raising-lowering wire rope 23 is coupled, is also applied with a force directed in a direction causing a distance therebetween to be reduced. That is, the swingable portion 78 of the rear strut 70 will be applied with a force directed in a direction causing it to be moved toward the front strut 60, i.e., a forward force. Thus, the swingable portion 78 of the rear strut 70 is swung forwardly. In this case, a portion of the jib raising-lowering wire rope 23 wound around between the rear sheave 73*c* at the distal end 73 of the rear strut 70 and the sheave 60 of the front strut 60 acts to apply a forward force to the distal end 73 of the rear strut 70. Thus, this portion functions as the pulling-returning rope 23*a* for pulling the distal end 73 of the rear strut 70 forwardly. Further, the rest sheave 73*c* functions as the second holding portion to which the pulling-returning rope 23*a* is coupled. In either of this case and the embodiment illustrated in FIG. 9, when a portion of the jib raising-lowering wire rope 23 coupled to the swingable portion 78 of the rear strut 70 (a portion of the jib raising-lowering wire rope 23 directly fixed to the swingable portion 78 or coupled to the swingable portion 78 via the rear sheave 73*c*) is pulled forwardly, a forward force is applied to the swingable portion 78 of the rear strut 70.

Figure 9:
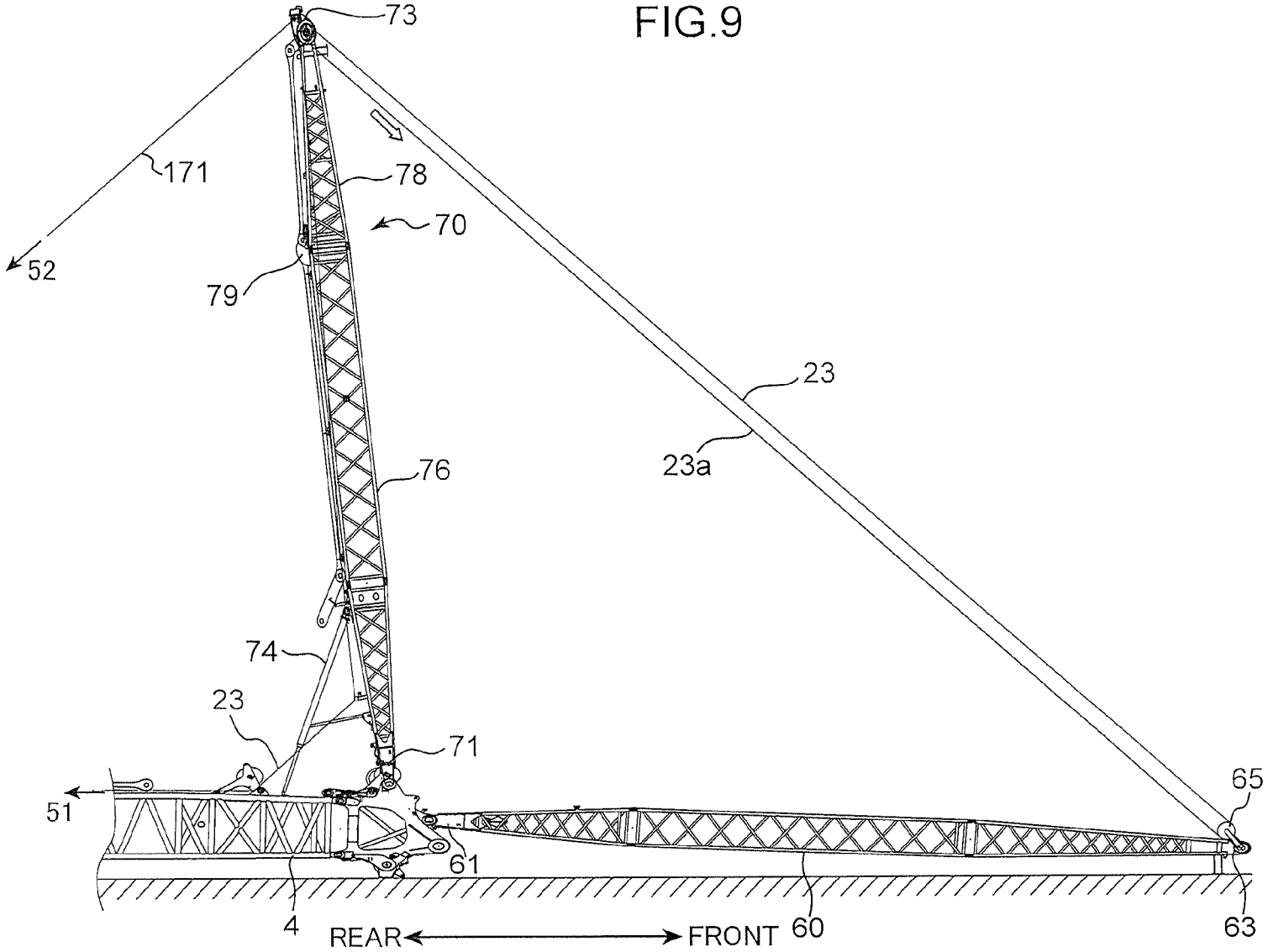
FIG. 9 is a side view depicting a part of the crane in a state after completion of the strut returning step.

In this state, the strut body portion 76 is set in the posture where it is inclined rearwardly with respect to the vertical direction. Thus, although a forward force is also applied to the strut body portion 76 via the swingable portion 78, the strut body portion 76 is not easily moved forwardly because of its own weight. Therefore, when the forward force is supplied to the distal end 73 of the swingable portion 78, the swingable portion 78 is swung forwardly about a pivot point defined by the joint between the swingable portion 78 and the strut body portion 76, as depicted in FIG. 9. As a result, the swingable portion 78 is set in a posture where it extends linearly from the strut body portion 76. That is, the rear strut 70 is set in a posture where the swingable portion 78 extends upwardly from the strut body portion 76 continuously with the strut body portion 76.

Particularly in this embodiment, as mentioned above, the strut body portion 76 of the rear strut 70 is coupled to the boom 4 through the back stop 74 in the second raising step, so that it is possible to keep down a forward movement of the strut body portion 76, and enable the swingable portion 78 to more easily swing with respect to the strut body portion 76.

The coupling between the rear strut 70 and the boom 4 by the back stop 74 may be performed after this strut returning step. However, when the coupling by the back stop 74 is performed before this strut returning step, it becomes possible to more easily realize the swing movement of the swingable portion 78.

(3-5) Coupling Step

After the rear strut 70 is set in the posture where the swingable portion 78 and the strut body portion 76 extend continuously upwardly, as mentioned above, the swingable portion 78 is coupled to the strut body portion 76 in a non-swingable state. That is, the swingable portion 78 and the strut body portion 76 are mutually coupled to each other so as to disable a relative swinging movement between the swingable portion 78 and the strut body portion 76.

Figure 10:
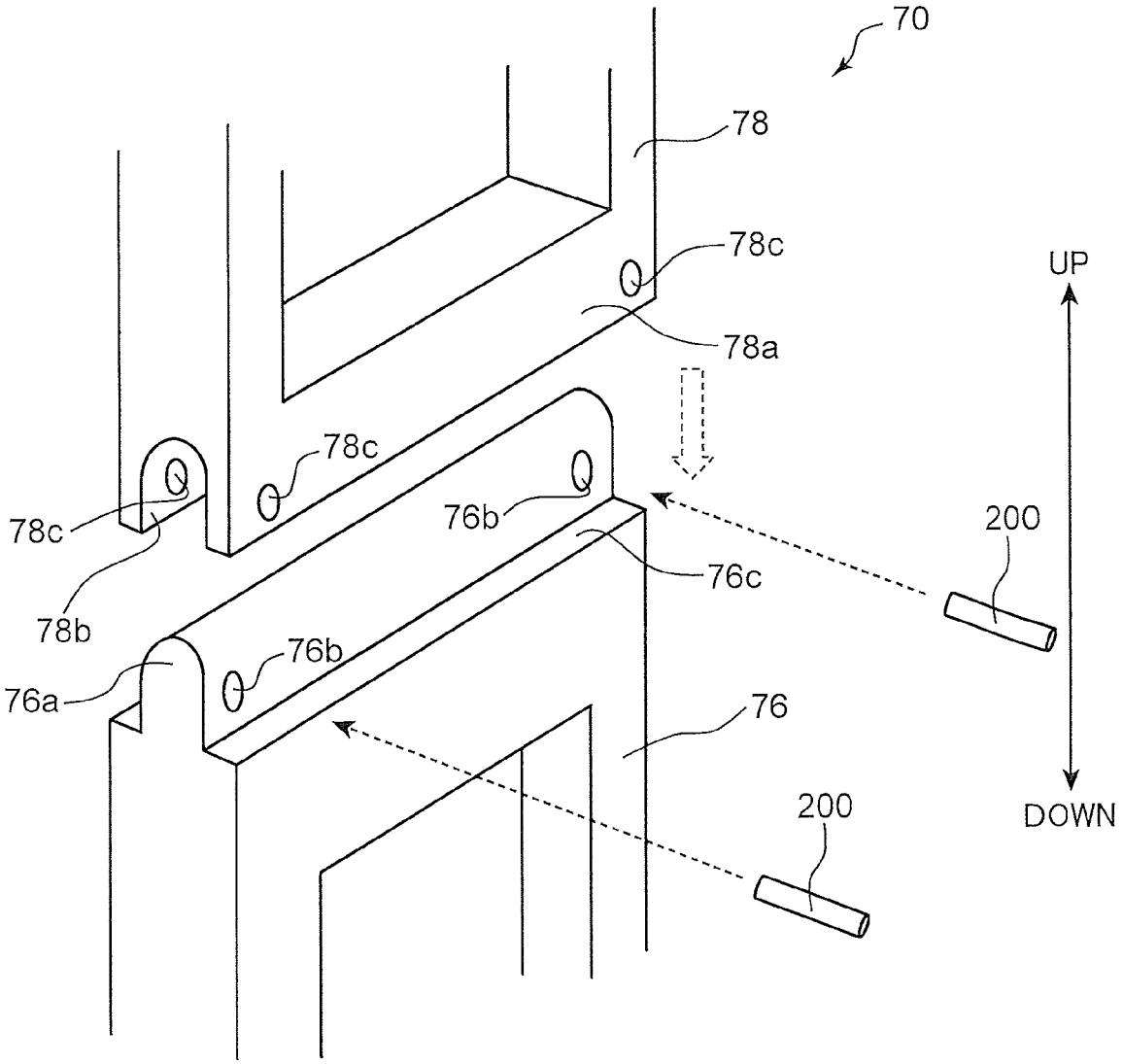
FIG. 10 is a schematic perspective view for explaining structure for non-swingably coupling the swingable portion and the strut body portion together.

FIG. 10 is a schematic perspective view enlargedly depicting a part of a coupling section between the swingable portion 78 and the strut body portion 76, in a state in which the swingable portion 78 is swingable with respect to the strut body portion 76. In the following descriptions in connection with FIGS. 3 and 10 and about the coupling section between the swingable portion 78 and the strut body portion 76, forward, rearward, upward and downward directions when of the rear strut 70 is in the state depicted in FIG. 8 will be used merely as forward, rearward, upward and downward directions, respectively. Thus, "forward (front)" and "rearward (rear)" depicted in FIG. 3 correspond, respectively, to "upward (up)" and "downward (down)" in the state depicted in FIG. 8, and "upward (up)" and "downward (down)" depicted in FIG. 2 correspond, respectively, to "rearward (rear)" and "forward (front)" in the state depicted in FIG. 8.

As depicted in FIG. 10 and other figure, a second lateral member 78*a* is provided on a lower edge of a front end of the swingable portion 78 to extend in a lateral (width) direction of the swingable portion 78 (a direction perpendicular to the drawing sheet of FIG. 8). This second lateral member 78*a* is formed with a receiving groove 78*b* opened in a lower surface thereof. The receiving groove 78*b* extends over an overall lateral length of the swingable portion 78 and has openings in laterally opposite side surfaces of the swingable portion 78. The second lateral member 78*a* is also formed with a second pin mounting hole 78*c* penetrating therethrough in the forward-rearward direction while being communicated with the receiving groove 78*b*. For example, the second pin mounting hole 78*c* is formed in each of laterally opposite regions of the second lateral member 78*a*.

An upper edge of a front (forward) end of the strut body portion 76, i.e., an upper edge face 76*c* of the front end is provided with a first coupling protrusion 76*a* extending in a lateral (width) direction of the strut body portion 76 (a direction perpendicular to the drawing sheet of FIG. 3) and protruding upwardly. The first coupling protrusion 76*a* has a shape fittingly insertable into the receiving groove 78*b*.

The first coupling protrusion 76*a* is formed with a first pin mounting hole 76*b* penetrating therethrough in the forward-rearward direction. The first pin mounting hole 76*b* is provided at a position where it is communicated with the second pin mounting hole 78*c* in the forward-rearward direction, in a state in which the first coupling protrusion 76*a* is fittingly inserted into the receiving groove 78*b*. For example, the first pin mounting hole 76*b* is formed in each of laterally opposite regions of the first coupling protrusion 76*a*.

The swingable portion 78 and the strut body portion 76 formed as above are configured such that, when the swingable portion 78 is swung forwardly and downwardly with respect to the strut body portion 76, as indicated by the arrowed line in FIG. 10, the first coupling protrusion 76*a* is fittingly inserted into the receiving groove 78*b*. In this state, the upper edge 76*c* of the strut body portion 76 comes into contact with the second lateral member 78*a* of the swingable portion 78 from therebelow to restrict a forward swinging movement of the swingable portion 78.

Then, in the above contact state, a pin 200 (swinging movement-restricting coupling member) is commonly inserted into the first pin mounting hole 76*b* and the second pin mounting hole 78*c*, so that the swingable portion 78 and the strut body portion 76 are coupled together in such a manner as to disenable a relative swinging movement therebetween.

For example, the pin 200 is inserted into and pulled out of the first pin mounting hole 76*b* and the second pin mounting hole 78*c*, using a hydraulic cylinder. A specific means for insertion and pull-out of the pin 200 is not limited thereto, and an electric motor or the like may be used.

FIG. 10 shows one example where the first coupling protrusion 76*a* extends over the overall length of the rear strut 70 in the lateral (width) direction thereof (direction perpendicular to the drawing sheet of FIG. 3 or 8), the first coupling protrusion 76*a* may be provided only in laterally opposite areas of the rear strut 70.

As above, in this embodiment, the entire rear strut 70 is pulled and raised with respect to the boom 4 in the state in which the relative swinging movement between the swingable portion 78 and the strut body portion 76 is restricted, without lifting the rear strut 70 upwardly using an auxiliary crane or the like.

After raising the entire the rear strut 70 from the boom 4 in a state in which the relative swinging movement between the swingable portion 78 and and the strut body portion 76 is restricted, the back stop 74 having one end fixed to the rear strut 70 is utilized such that the other end thereof is fixed to the boom to couple the rear strut 70 and the boom 4 together through the back stop 74.

Further, the pulling-raising wire rope 171 may be detached from the distal end 73 of the rear strut 70, or may be left in the state of being attached to the distal end 73 when there is difficulty in the detachment or the like. For example, the pulling-raising wire rope 171 may be composed of a first rope fixed to the auxiliary winch 52, and a second rope coupled to the first rope and attached to the distal end 73 of the rear strut 70, wherein the second rope has a length approximately equal to a length of the rear strut 70. In this case, coupling between the first and second ropes are released after the raising operation for the rear strut 70. Then, the second rope attached to the distal end 73 is fixed to a vicinity of the base end 71 of the rear strut 70.

(4) Functions, etc.

As above, in this embodiment, in the situation where the pulling-raising wire rope 171 and the rear strut 70 are disposed approximately parallel to each other, and an upward component of a force applied from the pulling-raising wire rope 171 to the rear strut 70 is kept down, only the low-weight the swingable portion 78 is pulled and raised. Then, in the situation where the pulling-raising wire rope 171 is pulled and raised, and thus the upward component of the force applied from the pulling-raising wire rope 171 to the rear strut 70 is increased, the second raising step is performed to pull and raise the strut body portion 76 and the entire rear strut 70. Thus, it becomes possible to pull and raise the rear strut 70 based on rearward pulling of the pulling-raising wire rope 171, while keeping down a force to be applied to the pulling-raising wire rope 171, i.e., a force required for the auxiliary winch 52.

By pulling the pulling-raising wire rope 171 rearwardly in this manner, and by winging the jib raising-lowering wire rope 23 to forwardly pull the portion 23*a* (pulling-returning rope 23*a*) of the jib raising-lowering wire rope 23 coupled to the distal end 73 of the swingable portion 78, as mentioned above, it is possible to pull and raise the entire rear strut 70 and set the rear strut 70 in an adequate posture. This makes it possible to omit an auxiliary crane for lifting the rear strut 70 to facilitate reduction in cost, and eliminate a need for ensuring an installation area for the auxiliary crane to thereby provide enhanced efficiency of the assembling operation.

In order to hold the rear strut 70 at a position spaced upwardly from the front strut 60 before fixing the pulling-raising wire rope 171 to the first holding portion 73*b*, an auxiliary crane may be used instead of the hydraulic jack. Even in this case, a lifting amount of the rear strut 70 necessary for the auxiliary crane is significantly small, so that it is possible to keep down performance (maximum lifting height) required for the auxiliary crane. That is, it is only necessary to prepare a simple auxiliary crane, so that it is possible to facilitate reduction in cost.

(5) Modifications

The above embodiment has been described based on an example where a part of the jib raising-lowering wire rope 23 is used as the pulling-returning rope 23*a* for forwardly pulling the distal end 73 of the swingable portion 78 in the pulling and returning step. However, the pulling-returning rope 23*a* is not limited thereto, but any other rope capable of pulling the distal end 73 of the swingable portion 78 forwardly may be used. For example, a sheave may be provided at the distal end 63 of the front strut 60 (the sheave 65 may be utilized), and a rope may be disposed to extend rearwardly from the distal end 73 of the swingable portion 78 via this sheave, and pulled rearwardly to apply a forward force to a part of this rope between the distal end 73 of the swingable portion 78 and the sheave to function as the pulling-returning rope 23*a*. In this case, this rope may be wound by a winch provided on the boom 4 or the like.

Further, a specific means to pull the pulling-returning rope 23*a* forwardly (in a direction away from the boom 4) is not limited to a winch. For example, it may be manually wound. Similarly, a specific means to pull the pulling-raising wire rope 171 rearwardly (toward the boom 4) is not limited to a winch.

Further, a specific configuration for mutually coupling the swingable portion 78 and the strut body portion 76 to each other in such a manner as to disenable a relative swinging movement therebetween is not limited to the above. For example, a laterally-extending lateral member of the swingable portion 78 and a laterally-extending lateral member of the strut body portion 76 may be coupled together by a coupling member or the like.

Further, a specific structure of the restriction portion 79 is not limited to the above. For example, a block-shaped member which extends over the overall lateral length of the swingable portion 78, or a rod-shaped member protruding from the strut body portion 76 toward the swingable portion 78, may be used.

Further, in the above embodiment, when the swingable portion 78 is swung rearwardly from a position forward of the restriction portion 79, the restriction portion 79 (inclined surface 79*a*) comes into contact with the swingable portion 78 to restrict the rearward swinging movement of the swingable portion 78 beyond a contact portion to thereby restrict a rear surface of the swingable portion 78 and a rear surface of the strut body portion 76 from coming closer to each other. Alternatively, a configuration may be employed in which a part of the swingable portion 78 on the forward side with respect to the swing shaft 70*a* is restricted from being spaced apart with respect to the strut body portion 76 by a given distance or more.

Figure 11:
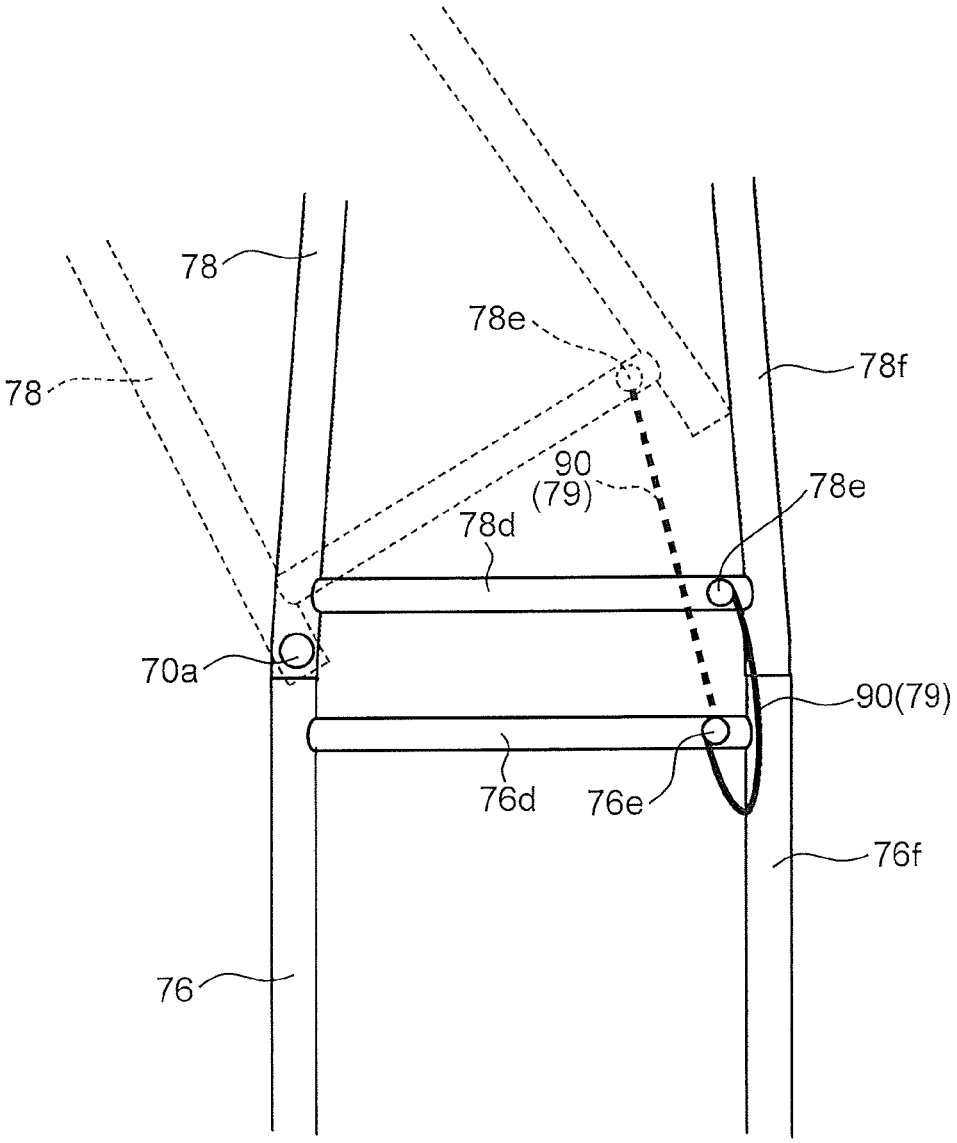
FIG. 11 is a schematic diagram depicting another example of a restricting portion.

For example, as depicted in FIG. 11, a rope 90 may function as the restriction portion 79. FIG. 11 is a schematic diagram enlargedly depicting a coupling section between the swingable portion 78 and the strut body portion 76, as with FIG. 3, except that, in FIG. 11, each of the portions 76, 78 is depicted in a simplified form.

Specifically, a strut body portion-side rope retainer 76*e* is provided in the vicinity of a front end of a lateral member 76*d* provided in the vicinity of the upper end of the strut body portion 76 to extend in the forward-rearward direction, and a swingable portion-side rope retainer 78*e* is provided in the vicinity of a front end of a lateral member 78*d* provided in the vicinity of a lower end of the swingable portion 78 to extend in the forward-rearward direction. Opposite ends of the rope 90 are fixed, respectively, to the rope retainers 78*e*, 76*e*. The rope 90 has an overall length equal to a spaced-apart distance between the swingable portion-side rope retainer 78*e* and the strut body portion-side rope retainer 76*e* (a length of a portion of the rope 90 extending between the strut body portion-side rope retainer 76*e* and the swingable portion-side rope retainer 78*e*) in a state in which the swingable portion 78 has been swung with respect to the strut body portion 76 by a preset given angle. As indicated by the broken line in FIG. 11, the rope 90 is brought to a tensioned state when the swingable portion 78 is swung with respect to the strut body portion 76 by the given angle, to thereby restrict a front end of the swingable portion 78 and a front end of the strut body portion 76 from being further spaced apart from each other, i.e., restrict the swingable portion 78 from being further swung rearwardly.

As long as positions where the rope 90 is fixed, respectively, to the swingable portion 78 and the strut body portion 76 are located forward of the swing shaft 70*a*, they are not limited to the example in FIG. 11. For example, the rope 90 may be fixed to respective main posts 78*f*, 76*f* of the swingable portion 78 and the strut body portion 76 each extending in an upward-downward direction.

Alternatively, a plurality of the ropes 90 may be used such that a plurality of pairs of opposite ends thereof are fixed to the swingable portion 78 and the strut body portion 76, at respective different positions in terms of a width directions of each of the swingable portion 78 and the strut body portion 76 (direction perpendicular to the drawing sheet of FIG. 11). Further, in place of the rope 90, other type of cord-like body such as a chain or a link member may be employed.

Although the above embodiment has been described based on an example where the crane X1 comprises, as a strut, the front strut 60 and the rear strut 70, the present invention may also be applied to a crane comprising only a single strut.

The aforementioned specific embodiment mainly includes inventions having the following features.

In order to achieve to above object, the present invention provides a strut raising method used for a crane comprising: a crane base; a boom attached to the crane base in a raisable and lowerable manner; a jib attached to the boom in a raisable and lowerable manner; and a strut for supporting the jib, wherein the strut has a base end attached to the boom in a raisable and lowerable manner and a distal end located on a side opposite to the base end. The strut raising method comprises: configuring the strut such that it comprises: a strut body portion including the base end; a swingable portion including the distal end, wherein the swingable portion is located closer to a distal edge of the strut than the strut body portion and swingably coupled to the strut body portion; and a restriction portion for restricting a swinging movement of the swingable portion with respect to the strut body portion; fixing a pulling-raising rope to a vicinity of the distal end of the strut, in a state in which the strut is located forward of the boom in terms of a forward-rearward direction of the boom, wherein the boom and the strut are laid down along an installation surface of the crane, and wherein the strut body portion is disposed to extend forwardly from the boom, and the swingable portion is disposed to extend forwardly from the strut body portion; performing a first raising operation of pulling the pulling-raising rope rearwardly to cause the swingable portion to swing upwardly and rearwardly with respect to the strut body portion after the fixing of the pulling-raising rope, up to a position where a rearward swinging movement of the swingable portion with respect to the strut body portion is restricted by the restriction portion; performing a second raising operation of pulling the pulling-raising rope rearwardly until the strut body portion has a rearwardly inclined posture with respect to a vertical direction after the first raising operation, to cause the strut body portion to swing upwardly and rearwardly with respect to the boom; pulling a pulling-returning rope coupled to the distal end of the strut forwardly to cause the swingable portion to swing forwardly with respect to the strut body portion after the second raising operation to thereby return the strut to a position where the strut body portion comes into contact with the swingable portion to thereby restrict the swingable portion from a relative forward swinging movement to the strut body portion; and coupling the swingable portion and the strut body portion to each other so as to prevent the swingable portion and the strut body portion from relative swinging movement to each other after returning the strut to the position where the strut body portion comes into contact with the swingable portion.

This method makes it possible to efficiently pull and raise the strut, while eliminating the use of an auxiliary crane for lifting the strut or while keep down performance (maximum lifting height and withstand load) required for the auxiliary crane.

Specifically, in this method, first of all, a rearward force is applied to a vicinity of a distal end of the swingable portion, so that it is possible to cause the swingable portion to swing upwardly and rearwardly about a pivot point defined by a joint between the swingable portion and the strut body portion. This makes it possible to pull a distal end-side portion (the swingable portion) of the strut upwardly.

In this process, when it is started to apply the rearward force to a vicinity of the distal end of the swingable portion, the strut is laid down at a height position adjacent to the installation surface of the strut. Thus, an upward component of the force applied to the strut when pulling the pulling-raising rope rearwardly at the height position adjacent to the installation surface is relatively small. However, in the first raising operation, only the swingable portion of the strut is swung upwardly and rearwardly, so that it is possible to keep down an upward force to be applied to the strut and thus reduce a force required to be applied to the pulling-raising rope.

Subsequently, by applying a rearward force to a vicinity of a distal end of the strut body portion in a state in which the rearward swinging movement of the swingable portion is restricted, the strut body portion can be swung upwardly and rearwardly about a pivot point defined by a joint between the strut body portion and the boom. This makes it possible to pull a base end-side portion (the strut base portion) of the strut upwardly.

In this process, the operation of pulling the base end-side portion (strut base portion) of the strut upwardly is performed in a state in which the distal end-side portion of the strut, i.e., the swingable portion to which the pulling-raising rope is fixed, is pulled upwardly. Thus, an upward component of the force applied from the pulling-raising rope to the strut during this operation can be increased, so that it is possible to pull and raise the strut body portion while keeping down a force to be applied to the pulling-raising rope.

Through this operation, the strut body portion is set in a posture where it is inclined rearwardly with respect to the vertical direction. Subsequently, a forward force is applied to a vicinity of the distal end of the swingable portion of the strut, so that it is possible to return the swingable portion while restricting a forward movement of the strut body portion based on its own weight. Thus, the swingable portion can be swung forwardly about the pivot point defined between the swingable portion and the strut body portion, and brought into contact with the strut body portion, so that it is possible to establish a state in which the swingable portion and the strut body portion are arranged to extend linearly, and the entire strut comprising the swingable portion and the strut body portion is set in a posture where it extends upwardly from the base end thereof continuously with the base end.

Further, in this state, the swingable portion and the strut body portion are non-swingably coupled together, so that it becomes possible to maintain the entire strut in a standing posture with respect to the boom.

Accordingly, the method of the present invention makes it possible to efficiently pull and raise the strut, without using any auxiliary crane and while keeping down a force necessary to pull and raise the strut.

The present invention also provides a crane comprising: a crane base; a boom attached to the crane base in a raisable and lowerable manner; a jib attached to the boom in a raisable and lowerable manner; and a strut for supporting the jib, wherein the strut has a base end attached to the boom in a raisable and lowerable manner and a distal end located on a side opposite to the base end. In the crane, the strut comprises: a strut body portion located on the side of the base end; a swingable portion located on the side of the distal end and swingably coupled to the strut body portion; a restriction portion for restricting the swingable portion from a relative swinging movement to the strut body portion in a direction causing the angle to be increased beyond the given value, when an angle between the strut body portion and the swingable portion becomes a given value; and a swinging movement-restricting coupling portion capable of coupling the strut body portion and the swingable portion to each other so as to prevent the strut body portion and the swingable portion from a relative swinging movement to each other, and wherein the strut has, in a vicinity of the distal end thereof, a first holding portion for allowing a pulling-raising rope for pulling the swingable portion toward the boom to be fixed thereto, and a second holding portion for allowing a pulling-returning rope for pulling the swingable portion in a direction away from the boom to be coupled thereto.

This crane can efficiently pull and raise the strut, while eliminating the use of an auxiliary crane for lifting the strut or while keep down performance (maximum lifting height and withstand load) required for the auxiliary crane.

Specifically, in this crane, by pulling the pulping-raising rope fixed to the first holding portion, it is possible to apply a force directed toward the boom to a vicinity of a distal end of the swingable portion, to cause the swingable portion to swing upwardly and toward the boom about a pivot point defined by a joint between the swingable portion and the strut body portion. Subsequently, by further pulling the pulping-raising rope toward the boom, it is possible to apply a force directed toward the boom to a vicinity of the distal end of the swingable portion while restricting a rearward swinging movement of the swingable portion toward the boom with respect to the strut body by the restriction portion, to thereby cause the strut body portion to swing upwardly and toward the boom about a pivot point defined by a joint between the strut body portion and the boom. This makes it possible to pull and raise a base end-side portion (the strut base portion) of the strut.

As above, in this crane, in a situation where the strut is laid down on the ground, and thus an upward component of a force applied from the pulling-raising rope to the strut is relatively small, only the swingable portion of the strut is pulled and raised, and the strut body portion can be pulled and raised after the swingable portion, i.e., a distal end-side portion of the strut to which the pulling-raising rope is fixed, is pulled upwardly, i.e., in a state in which the upward component of the force applied from the pulling-raising rope to the strut is sufficiently increased. Thus, it becomes possible to adequately pull and raise the strut, while keeping down a force to be applied to the pulling-raising rope so as to pull and raise the strut.

Then, after raising the base end-side portion of the strut with respect to the boom, the pulling-returning rope fixed to the second holding portion is pulled in a direction away from the boom, so that it is possible to apply a force directed in the direction away from the boom to a vicinity of the distal end of the swingable portion, to cause the swingable portion to swing in the direction away from the boom about a pivot point defined by a joint between the swingable portion and the strut body portion, to thereby set the swingable portion and the strut body portion in a posture where they extend linearly, i.e., set the entire strut in a posture where it extends upwardly from the base end thereof. Further, in this state, the swingable portion and the strut body portion are coupled together by the coupling member, so that it becomes possible to maintain the entire strut in a standing posture with respect to the boom.

Accordingly, the crane of the present invention can efficiently pull and raise the strut, without using any auxiliary crane and while keeping down a force necessary to pull and raise the strut.

This application is based on Japanese Patent application No. 2017-110704 filed in Japan Patent Office on Jun. 5, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A strut raising method used for a crane comprising: a crane base; a boom attached to the crane base in a raisable and lowerable manner; a jib attached to the boom in a raisable and lowerable manner; and a strut for supporting the jib, the strut having a base end attached to the boom in a raisable and lowerable manner and a distal end located on a side opposite to the base end, the strut raising method comprising:

configuring the strut such that it comprises: a strut body portion including the base end; a swingable portion including the distal end, the swingable portion being located closer to a distal edge of the strut than the strut body portion and swingably coupled to the strut body portion; and a restriction portion for restricting a swinging movement of the swingable portion with respect to the strut body portion;

fixing a pulling-raising rope to a vicinity of the distal end of the strut, in a state in which the strut is located forward of the boom in terms of a forward-rearward direction of the boom, wherein the boom and the strut are laid down along an installation surface of the crane, and wherein the strut body portion is disposed to extend forwardly from the boom, and the swingable portion is disposed to extend forwardly from the strut body portion;

performing a first raising operation of pulling the pulling-raising rope rearwardly to cause the swingable portion to swing upwardly and rearwardly with respect to the strut body portion after the fixing of the pulling-raising rope, up to a position where a rearward swinging movement of the swingable portion with respect to the strut body portion is restricted by the restriction portion;

performing a second raising operation of pulling the pulling-raising rope rearwardly until the strut body portion has a rearwardly inclined posture with respect to a vertical direction after the first raising operation, to cause the strut body portion to swing upwardly and rearwardly with respect to the boom;

pulling a pulling-returning rope coupled to the distal end of the strut forwardly to cause the swingable portion to swing forwardly with respect to the strut body portion after the second raising operation to thereby return the strut to a position where the strut body portion comes into contact with the swingable portion to thereby restrict the swingable portion from a relative forward swinging movement to the strut body portion; and coupling the swingable portion and the strut body portion to each other so as to prevent the swingable portion and the strut body portion from relative swinging movement to each other after returning the strut to the position where the strut body portion comes into contact with the swingable portion.

2. A crane comprising:

a crane base;

a boom attached to the crane base in a raisable and lowerable manner;

a jib attached to the boom in a raisable and lowerable manner; and a strut for supporting the jib, the strut having a base end attached to the boom in a raisable and lowerable manner and a distal end located on a side opposite to the base end, wherein the strut comprises:

a strut body portion located on the side of the base end;

a swingable portion located on the side of the distal end and swingably coupled to the strut body portion;

a restriction portion for restricting the swingable portion from a relative swinging movement to the strut body portion in a direction causing the angle to be increased beyond the given value, when an angle between the strut body portion and the swingable portion becomes a given value; and a swinging movement-restricting coupling portion capable of coupling the strut body portion and the swingable portion to each other so as to prevent the strut body portion and the swingable portion from a relative swinging movement to each other, and wherein the strut has, in a vicinity of the distal end thereof, a first holding portion for allowing a pulling-raising rope for pulling the swingable portion toward the boom to be fixed thereto, and a second holding portion for allowing a pulling-returning rope for pulling the swingable portion in a direction away from the boom to be coupled thereto.

* * * * *